US012735234B2

(12) United States Patent
Wong et al.

(10) Patent No.: US 12,735,234 B2
(45) Date of Patent: Sep. 15, 2026

(54) LID ASSEMBLY FOR BEVERAGE CONTAINER

(71) Applicant: AEGIS GLOBAL RESOURCES (HK) LIMITED, Hong Kong (CN)

(72) Inventors: Siu Wah Wong, Hong Kong (CN); Fat Sun Kwok, Hong Kong (CN)

(73) Assignee: AEGIS GLOBAL RESOURCES (HK) LIMITED, Hong Kong (CN)

( * ) Notice: Subject to any disclaimer, the term of this patent is extended or adjusted under 35 U.S.C. 154(b) by 307 days.

(21) Appl. No.: 18/633,030

(22) Filed: Apr. 11, 2024

(65) Prior Publication Data

US 2024/0400270 A1 Dec. 5, 2024

Related U.S. Application Data

(60) Provisional application No. 63/469,947, filed on May 31, 2023.

(51) Int. Cl.

| | |
|---|---|
| ***B65D 47/32*** | (2006.01) |
| ***B65D 43/02*** | (2006.01) |
| ***B65D 47/08*** | (2006.01) |

(52) U.S. Cl.

CPC ..... *B65D 47/32* (2013.01); *B65D 43/0231* (2013.01); *B65D 47/0857* (2013.01); *B65D 2543/00046* (2013.01); *B65D 2543/00092* (2013.01)

(58) Field of Classification Search

CPC ..... B65D 47/32; B65D 47/04; B65D 47/00; B65D 47/0857; B65D 47/08; B65D 47/06

See application file for complete search history.

(56) References Cited

U.S. PATENT DOCUMENTS

| | | | | |
|---|---|---|---|---|
| 8,960,490 | B2 * | 2/2015 | Carlile | B65D 47/249 220/264 |
| 9,113,698 | B2 * | 8/2015 | Blain | B65D 43/22 |
| 9,908,687 | B2 * | 3/2018 | Chiou | A45F 3/16 |
| 2015/0201776 | A1 * | 7/2015 | Elsaden | A47G 19/2272 220/715 |
| 2018/0244441 | A1 * | 8/2018 | Wodka | B65D 51/1683 |

* cited by examiner

*Primary Examiner* — Javier A Pagan
(74) *Attorney, Agent, or Firm* — WPAT, PC

(57) ABSTRACT

A lid assembly for a beverage container, comprising a lid body adapted for detachably coupled to the beverage container, the lid body having a drink orifice and a gas vent, each being sealable to block fluid communication with the beverage container; a first sealing mechanism configured for sealing and unsealing the gas vent; a second sealing mechanism configured for sealing and unsealing the drink orifice; an actuator for actuating and de-actuating the first and second sealing mechanisms. The actuator is configured for sequentially actuating the first and the second sealing mechanisms, causing the gas vent to unseal as a result of an initial actuation of the actuator, and subsequently causing the drink orifice to unseal as a result of a further actuation of the actuator.

14 Claims, 7 Drawing Sheets

LID ASSEMBLY FOR BEVERAGE CONTAINER

FIELD OF THE INVENTION

This invention relates to a lid assembly for a beverage container, and particularly, to a lid assembly that includes a sealing mechanism and a mechanism for opening and closing drink orifice and gas vent thereof.

BACKGROUND OF THE INVENTION

Various beverage containers designed to keep the beverages inside warm are available in the art. These containers typically feature a lid attached to the container body, with the lid having a drink orifice through which the beverage is dispensed. When dispensing a hot beverage, the hot air within the container often escapes rapidly through the drink orifice alongside the beverage, spraying onto the drinker's face and causing discomfort.

To address this issue, some recent beverage containers include a gas vent in the lid, allowing the hot air inside the container to escape, along with a mechanism for opening and closing this gas vent. Often, these containers are designed to open both the gas vent and the drink orifice at the same time, leaving no opportunity for the hot air to escape through the gas vent before the user drinks from the drink orifice. In other designs, the user must perform an additional action (such as activating a switch) to manually open the gas vent. This approach may lead to situations where users forget to open the gas vent before drinking, thus negating the vent's intended function.

Recently, a kind of mechanism to open the vent seal before opening the drink seal has been provided, which, however, may suffer from a complicated structure.

Therefore, there is a demand for a beverage container equipped with a mechanism that ensures the user opens the gas vent before the drink orifice, enabling the beverage to be dispensed safely from the container.

SUMMARY OF INVENTION

One of the principal objects of the invention is to provide a beverage container that comprises a mechanism to ensure that the drink orifice can only be opened after the gas vent is opened.

This and other objects are satisfied by the present invention, which provides a lid assembly for a beverage container, the lid assembly may comprise:

- a lid body comprising a top surface defining a drink orifice and a gas vent formed therethrough, a drink lever pivotally mounted on the lid body;
- a drink seal for closing the drink orifice and mounted atop the drink lever to move pivotally along with the pivotal movement of the drink lever;
- a vent lever pivotally mounted on the drink lever and/or the lid body;
- a vent seal for closing the gas vent and mounted atop the vent lever to move pivotally along with the pivotal movement of the vent lever; and
- an actuator element movable within the lid body;
- wherein the actuator element is configured to move in a direction in order to pivot the vent lever downwardly so that the vent seal moves away from the gas vent to open the gas vent, and the vent lever pivots downwardly to act on the drink lever thereby causing the drink lever to pivot downwardly, so that the drink seal moves away from the drink orifice.

Preferably and optionally, the lid assembly further comprises a cover comprising a pivot through which the cover is pivotally mounted on the lid body for pivotal movement to cover or expose the drink orifice and the gas vent, and the pivot is configured to have an arcuate recess formed peripherally. The recess is operably in fluid communication with the gas vent to allow the gas to escape when the gas vent is opened.

According to one aspect of the invention, there is provided a lid assembly for a beverage container, comprising:

- a lid body adapted for detachably coupled to the beverage container, the lid body having a drink orifice and a gas vent, each being sealable to block fluid communication with the beverage container;
- a first sealing mechanism configured for sealing and unsealing the gas vent;
- a second sealing mechanism configured for sealing and unsealing the drink orifice;
- an actuator for actuating and de-actuating the first and second sealing mechanisms;
- wherein the actuator is configured for sequentially actuating the first and the second sealing mechanisms, causing the gas vent to unseal as a result of an initial actuation of the actuator, and subsequently causing the drink orifice to unseal as a result of a further actuation of the actuator.

In some embodiments, the actuator is further configured for causing the drink orifice to seal as a result of an initial de-actuation of the actuator, and subsequently causing the gas vent to seal as a result of a further de-actuation of the actuator.

In some embodiments, the second sealing mechanism comprises a drink lever movable between a sealed position and an unsealed position, a biasing element is provided to bias the drink lever toward the sealed position.

In some embodiments, the first sealing mechanism comprises a vent lever, the vent lever is mounted on the drink lever and is movable between a sealed position and an unsealed position, a biasing element is provided to bias the vent lever toward the sealed position.

In some embodiments, the vent lever is pivotable between the sealed position, the unsealed position, and a threshold position in which an abutting portion of the vent lever abuts against the drink lever.

In some embodiments, the actuator comprises a cam surface adapted for engaging with an inclined surface on the vent lever, and wherein upon initial actuation of the actuator, the cam surface imparts a pivotal action on the vent lever toward the threshold position.

In some embodiments, further actuation of the actuator causes the vent lever, at the threshold position, to impart a pivoting action on the drink lever toward its unsealed position.

In some embodiments, the actuator is moveable in a linear direction.

In some embodiments, the first and second sealing mechanisms comprise respective sealing members, the sealing members are formed of a resilient material to provide a substantially fluid-tight seal when in the closed position.

In some embodiments, the biasing element of the drink lever and/or the vent lever is a torsion spring.

In some embodiments, the lid body further comprises a coupling portion extending downwardly from the top surface, the coupling portion being configured to engage a corresponding rim of the beverage container to provide a substantially fluid-tight seal.

In some embodiments, the lid assembly further comprising a cover adapted for concealing the drink orifice and the gas vent.

In some embodiments, the cover is pivotally mounted on the lid body, and is pivotable between an open position and a closed position.

In some embodiments, the cover comprises an arcuate recess, with the cover in the open position, the arcuate recess aligns with the gas vent for allowing gas to exit from the gas vent therethrough.

In some embodiments, the cover is configured such that in the closed position the actuator is prohibited from being actuated.

According to another aspect of the invention, there is provided a lid assembly for a beverage container, comprising:

a lid body comprising a top surface defining a drink orifice and a gas vent formed therethrough, a drink lever pivotally mounted within the lid body;

a drink seal provided on the drink lever which is spring-biased toward the drink orifice to form a seal for the drink orifice;

a vent lever pivotally mounted within the lid body;

a vent seal provided on the vent lever which is spring-biased toward the gas vent to form a seal for the gas vent; and an actuator movable with respect to the lid body;

wherein the actuator is configured to, when moving in an actuating direction, engage with the vent lever to cause the vent lever to pivot downward to unseal the gas vent, and moving the actuator further in the actuating direction causes the vent lever to act on the drink lever to pivot the drink lever downward, thereby unsealing the drink orifice.

In some embodiments, the vent lever is pivotally mounted on the drink lever.

In some embodiments, the lid assembly further comprising a cover adapted for concealing the drink orifice and the gas vent.

In some embodiments, the cover is pivotally mounted on the lid body, and is pivotable between an open position and a closed position.

In some embodiments, the cover comprises an arcuate recess, with the cover in the open position, the arcuate recess aligns with the gas vent for allowing gas to exit from the gas vent therethrough.

DESCRIPTION OF THE DRAWINGS

The present invention will now be more specifically described by way of example only with reference to the accompanying drawings, in which.

DETAILED DESCRIPTION OF PREFERRED EMBODIMENTS OF THE INVENTION

Figure 1A:
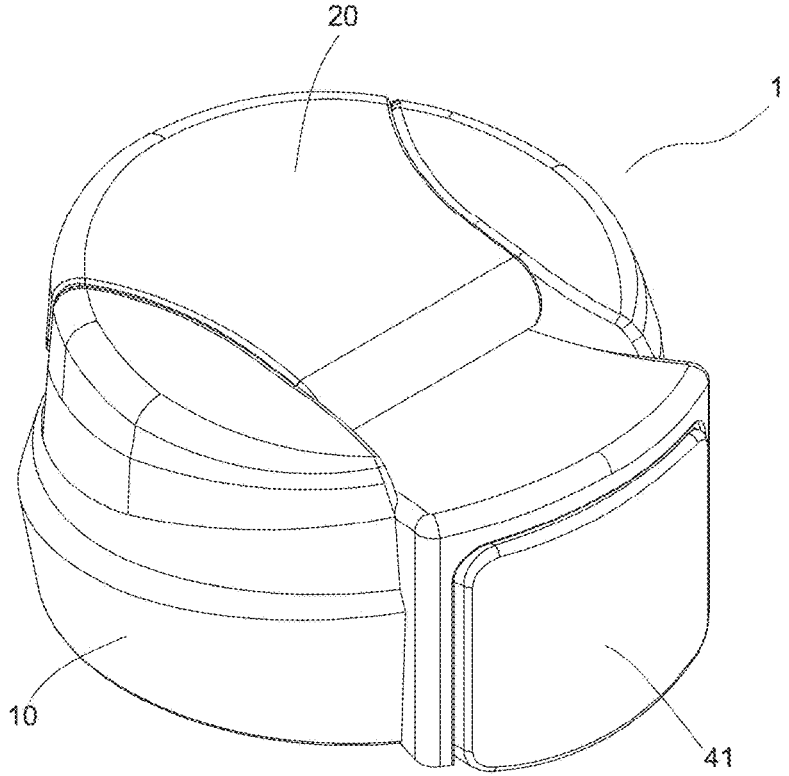
FIGS. 1A and 1B are perspective top views of a container lid assembly according to an embodiment of the present invention, with the cover in a fully closed position and a fully open position.

The following clearly and completely describes the technical solutions in the embodiments of the present invention with reference to the accompanying drawings. Apparently, the described embodiments are merely some but not all of the embodiments of the present invention. All other embodiments based on the embodiments of the present invention and obtained by a person of ordinary skill in the art without investing creative efforts shall fall within the scope of the present invention.

Referring now to the drawings, FIGS. 1A to 7C illustrate a container lid assembly 1 constructed consistent with a preferred embodiment of the invention. The lid assembly is adapted for removable placement on an open top of the container (not shown). The container is used to contain or store beverage and may be of any type known in the art.

Figure 3:
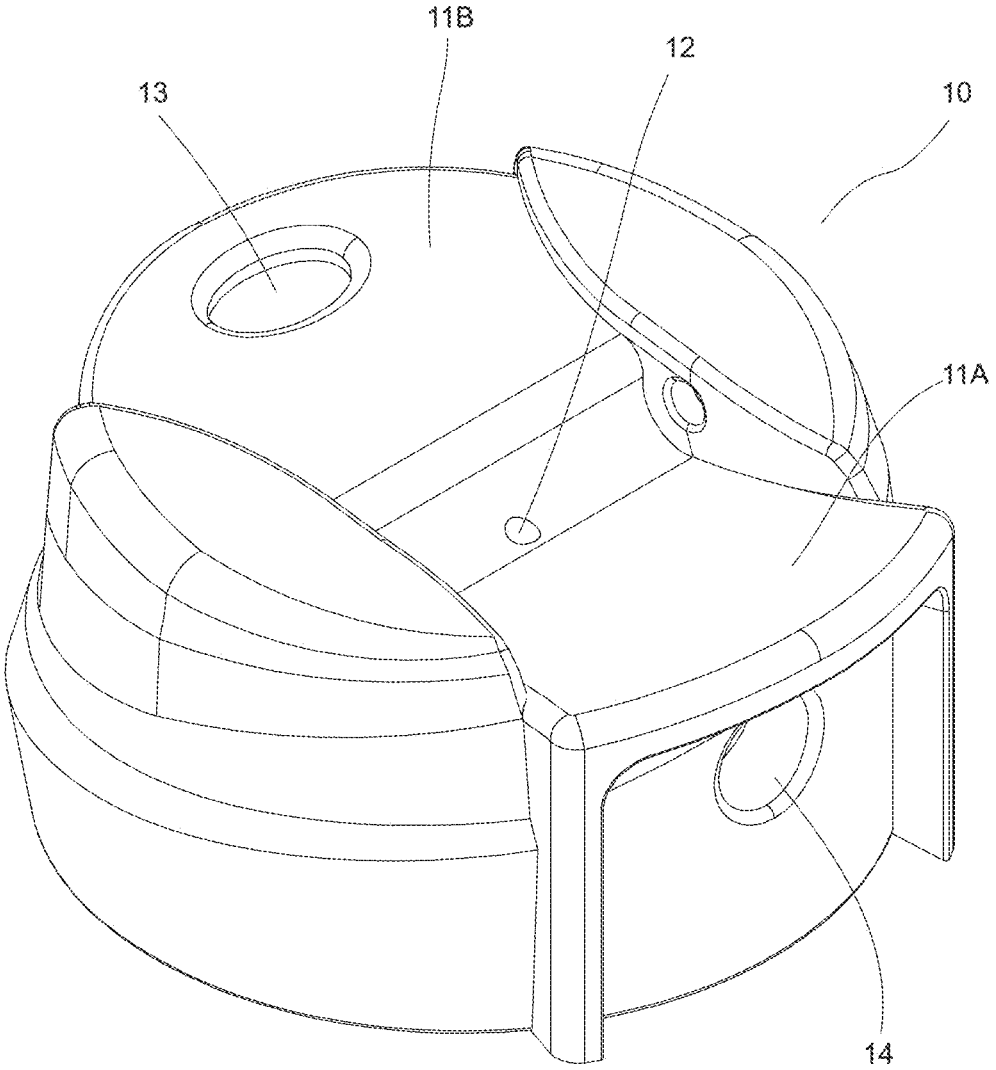
FIG. 3 is a perspective top view of the lid body according to an embodiment of the present invention.
Figure 4:
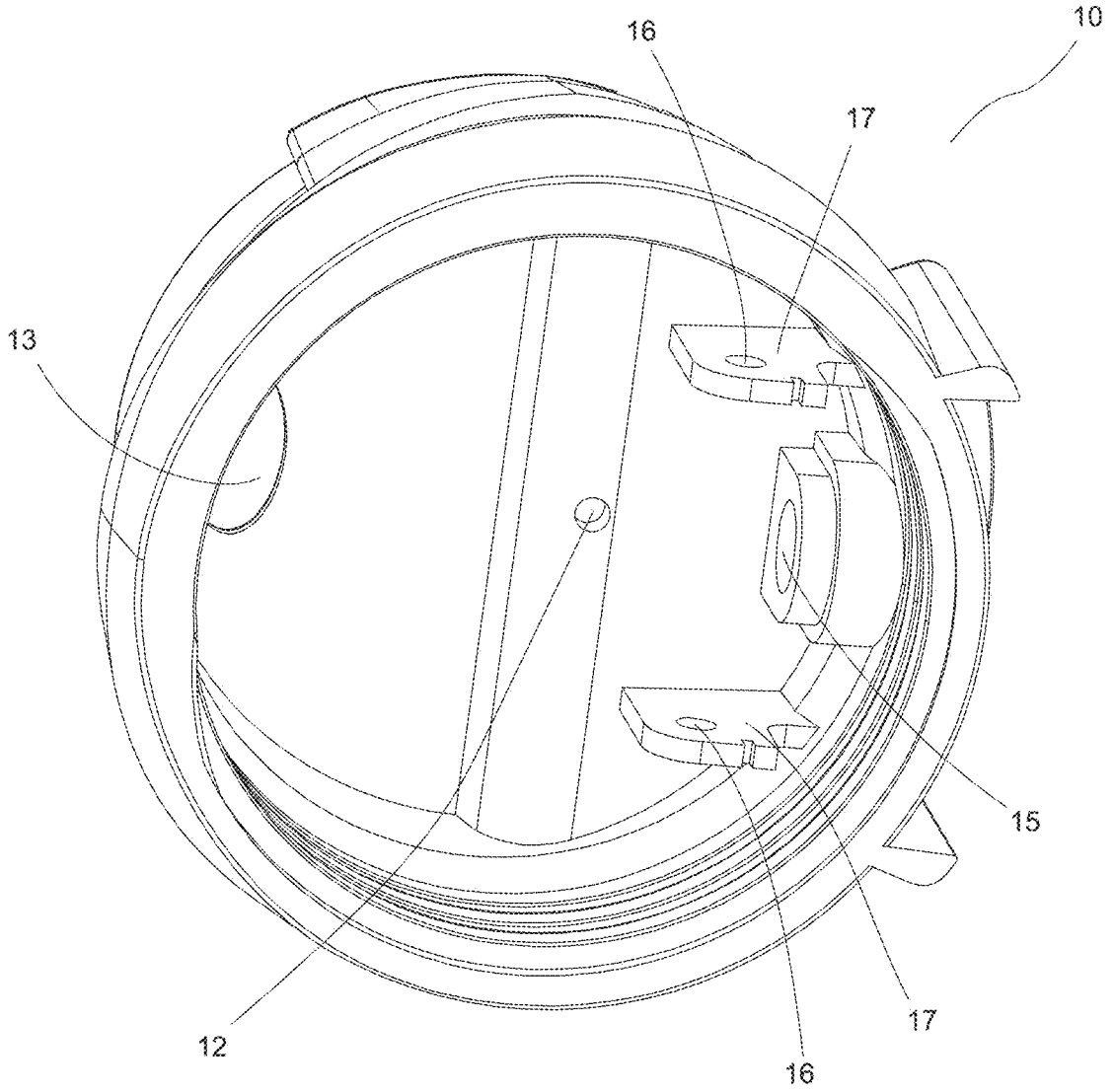
FIG. 4 is a perspective bottom view of the lid body shown in FIG. 3.
Figure 5:
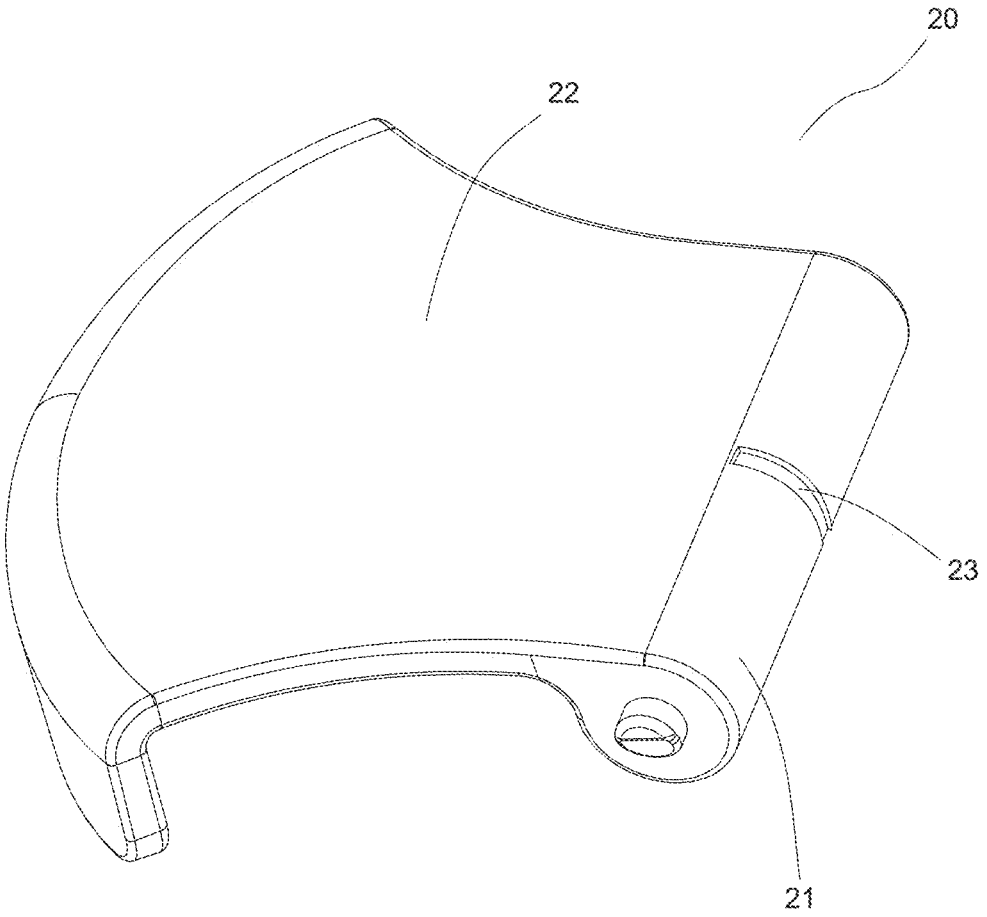
FIG. 5 is a perspective bottom view of the cover according to an embodiment of the present invention.

The lid assembly 1 comprises a lid body 10, a cover 20 pivotally mounted on the lid body 10, a sealing mechanism and a trigger mechanism. As best seen in FIGS. 3 and 4, the lid body 10 comprises a top surface having a first lower surface zone 11A defining a gas vent 12 for releasing the gas in the container, and a second raised surface zone 11B defining a drink orifice 13 in the vicinity of the periphery of the lid body 10 for dispensing the beverage accommodated in the container. Each of the gas vent 12 and the drink orifice 13 is sealable to block fluid communication with the container. In an embodiment, the lid assembly 1 may include a first sealing mechanism for sealing and unsealing the gas vent 12, and a second sealing mechanism for sealing and unsealing the drink orifice 13. The first and second sealing mechanisms may include respective sealing members, the sealing members may be formed of a resilient material to provide a substantially fluid-tight seal when in the closed position.

The lid body 10 includes a side opening 14 and a holder 15 that extends horizontally through a side wall of the lid body and is open to the side opening 14. Preferably, the lid body is adapted for detachably coupled to the beverage container. The lid body 10 may further include a coupling portion extending downwardly from the top surface, the coupling portion can be configured to engage a corresponding rim of the beverage container to provide a substantially fluid-tight seal. In an embodiment, the lid body 10 has internal threads formed on an inner wall surface thereof, which internal threads cooperate with external threads formed on an outer surface of the top wall of the container to secure the lid assembly to the container.

Figure 1B:
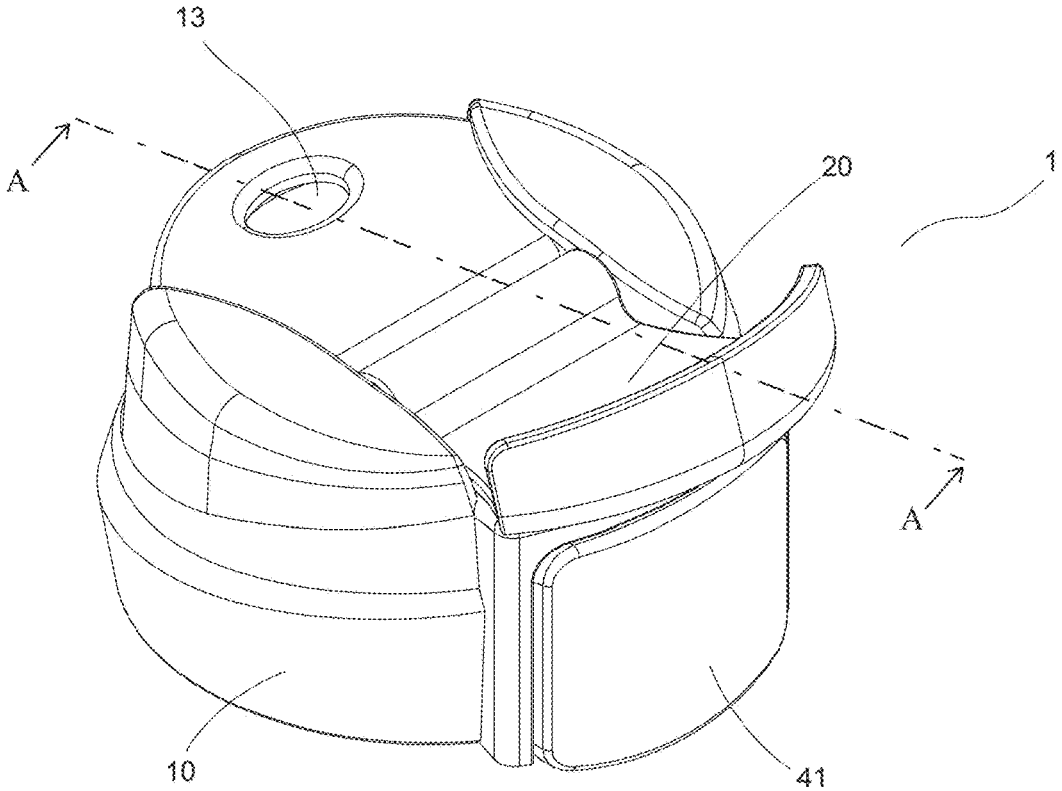
Figure 2:
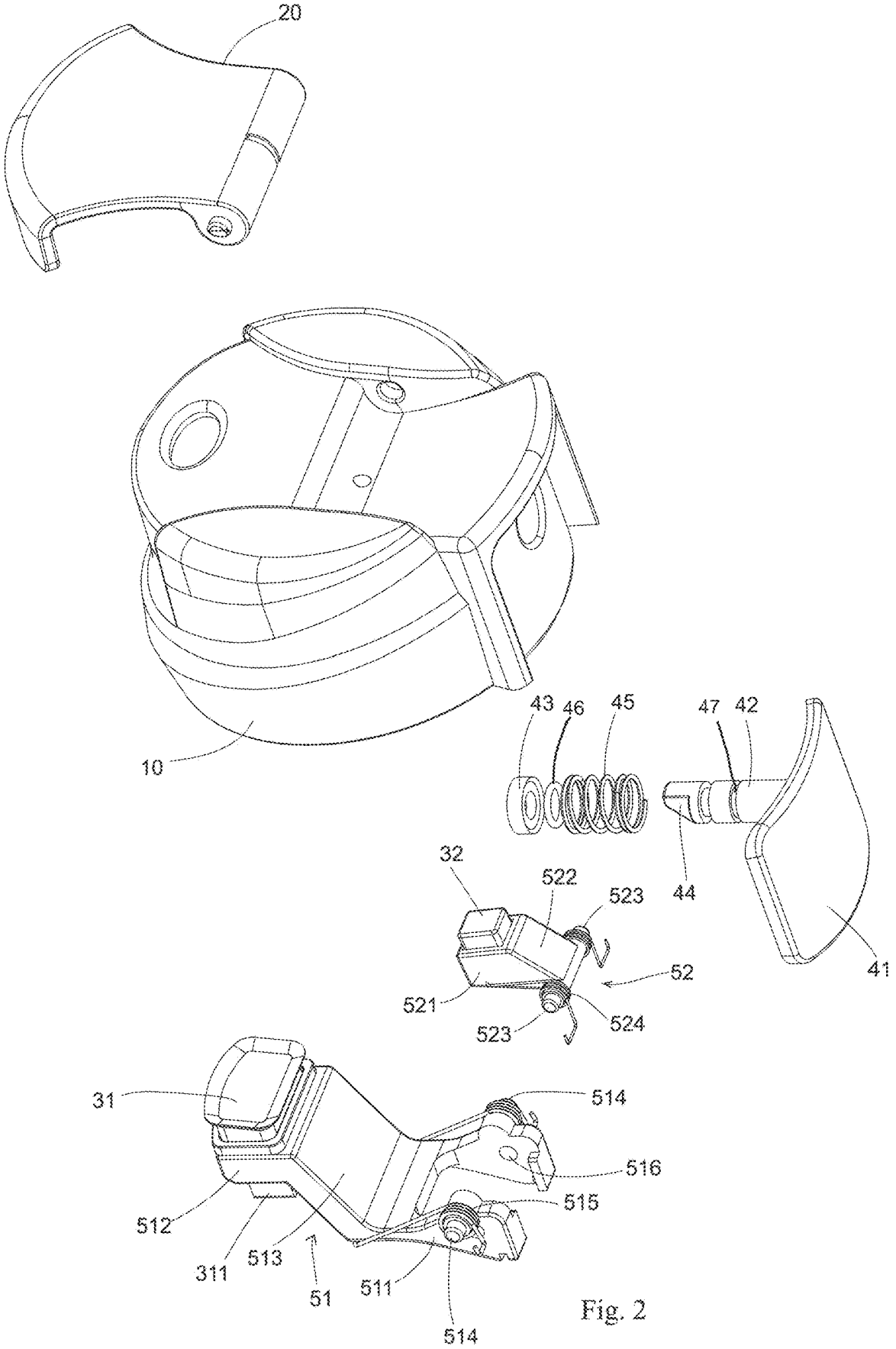
FIG. 2 is an exploded perspective view of the lid assembly shown in FIG. 1A and FIG. 1B.

The cover 20 is provided for concealing the drink orifice and the gas vent may be pivotally mounted and movable between a closed position, as shown in FIG. 1, and an open position as shown in FIG. 2. The cover 20 comprises a pivot 21 configured as a substantially cylindrical shaft in this embodiment, and a cover plate 22 extending from a top wall of the pivot 21 in a plane parallel to an axis of the pivot 21. The cover 20 may be mounted on the top surface of the lid body 10 in such a manner that the cover 20 is able to pivot around the axis of the pivot 21 by at least about 180 degrees, between the fully closed position and the fully open position. An arcuate recess 23 may be formed circumferentially in the middle of the wall of the pivot 21 on a side opposite to the cover plate 22. Preferably, the recess 23 extends circumferentially right above the gas vent 12. With the cover in the open position, the arcuate recess 23 aligns with the gas vent 12 for allowing gas to exit from the gas vent therethrough.

The trigger mechanism specifically comprises an actuator 42, of which a portion of the actuator 42 may be a push button 41 for engaging by the user. The actuator 42 may be slidably received into and within the lid interior of the lid body 10 through the side opening 14 of the lid body 10. The actuator 42 is configured so as to actuate and de-actuate the first and second sealing mechanisms through pressing and releasing the button 41. Preferably, the cover 20 may be configured such that in the closed position the actuator 42 is prohibited from being actuated.

Figure 6A:
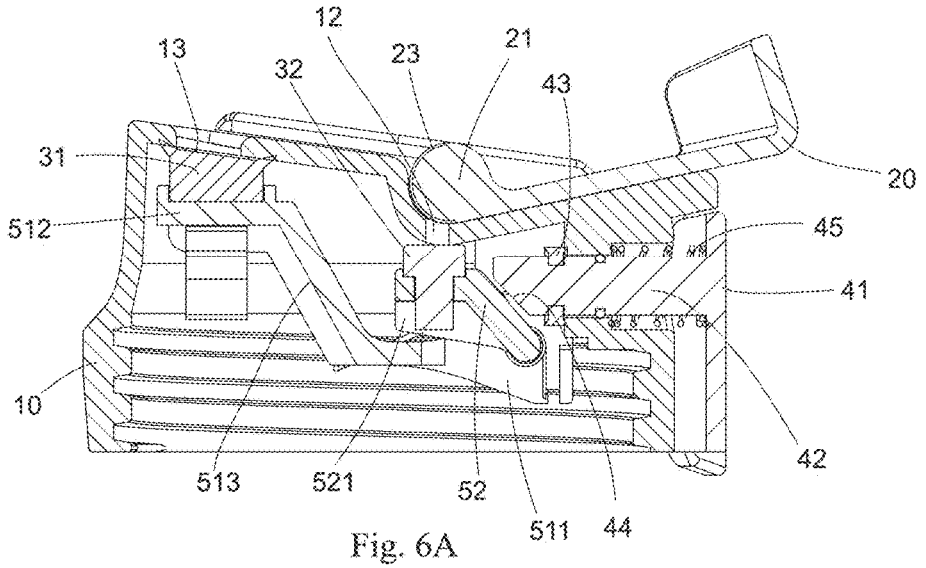
FIG. 6A is a cross-sectional view of the lid assembly taken along line A-A of FIG. 1B, with both the drink seal and the vent seal in closed position.
Figure 6B:
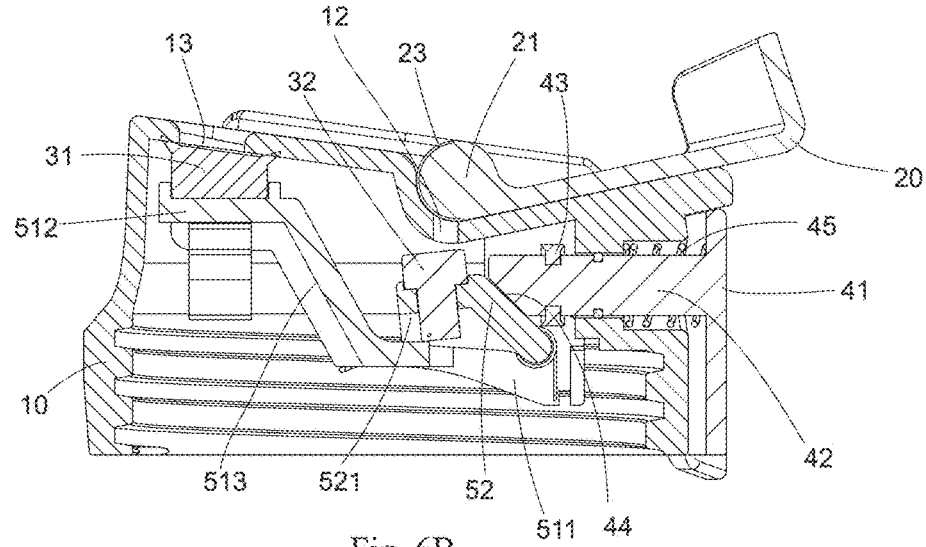
FIG. 6B is a cross-sectional view of the lid assembly taken along line A-A of FIG. 1B, with the vent seal of the sealing mechanism in open position and the drink seal in closed position.
Figure 6C:
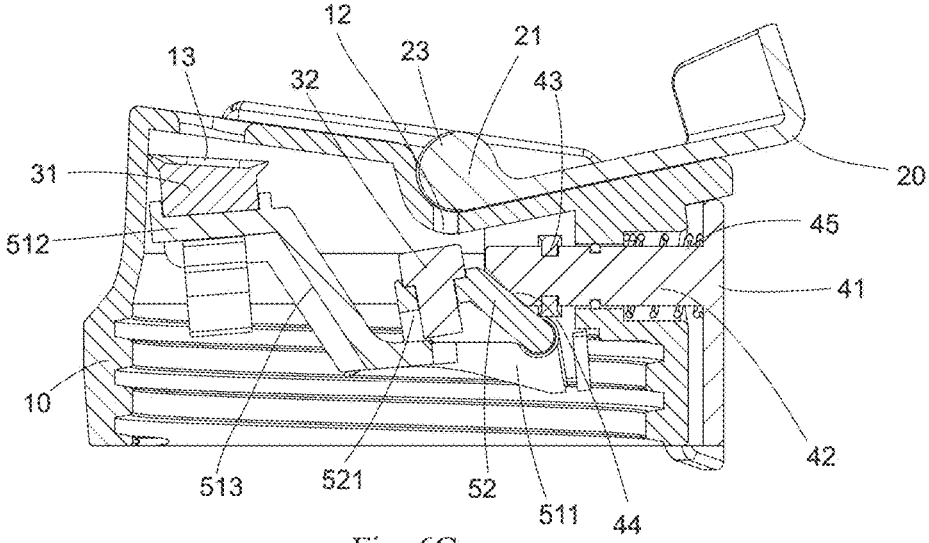
FIG. 6C is a cross-sectional view of the lid assembly taken along line A-A of FIG. 1B, with both the drink seal and the vent seal both in open position.

As shown in FIGS. 6A-6C, the push button 41 is arranged to be exposed, and the actuator 42 extends through the holder 15 and is displaceable within the holder 15 and the lid interior when the push button 41 is pressed. Preferably, a trigger seal 43 is provided on the actuator 42 to prevent the beverage and gas from escaping from the container through the holder 15 of the lid body 10. To reinforce the sealing effect for the lid assembly 1 when the actuator 42 is displaceable in the holder 15 and the lid interior, a supplementary sealing ring 46 is snugly sleeved on a circular notch 47 formed on an outer circumferential surface of the actuator 42. When the push button 41 is pressed to move the actuator 42 inwardly, as shown in FIGS. 6B and 6C, the gas vent 12 and the drink orifice 13 are opened sequentially; and when the push button 41 is released, as shown in FIG. 6A, the actuator 42 moves in a direction towards the push button 41 to cause the drink orifice 13 and the gas vent 12 closed sequentially. In other words, the drink orifice 13 is opened after the gas vent 12 is open to allow the gas to exit. Such a configuration is advantageous, especially in the case of dispensing hot beverages from the container, because it ensures that the hot gas in the container exits from the gas vent 12 before the drink orifice 13 is opened, preventing the hot gas from spurting out the drink orifice 13 and at the user. That is to say, the actuator 42 can be configured for sequentially actuating the first and the second sealing mechanisms, causing the gas vent 12 to unseal as a result of an initial actuation of the actuator 42, and subsequently causing the drink orifice 13 to unseal as a result of a further actuation of the actuator 42. Advantageously, the actuator 14 may be further configured for causing the drink orifice 13 to seal as a result of an initial de-actuation of the actuator 42, and subsequently causing the gas vent 12 to seal as a result of a further de-actuation of the actuator 42.

More preferably, the cover 20 is configured such that when the cover 20 is in the closed position, the push button 41 cannot be pressed, and only when the cover 20 is in the open position will the user be able to press the push button 41 to move the actuator 42.

Now turning to FIG. 2, the second sealing mechanism includes a drink seal 31 for closing the drink orifice 13, while the first sealing mechanism includes a vent seal 32 for closing the gas vent 12 to prevent the beverage and the gas from escaping from the container.

The second sealing mechanism may include a drink lever 51 movable or pivotable between a sealed position and an unsealed position. The drink lever 51 may be provided with a lower portion 511, an upper portion 512 and a connecting portion 513 connecting the lower and upper portions 511, 512. The drink lever 51 may be pivotally mounted on the lid body 10 by inserting two stubs 514 extending from opposite outer surfaces of the lower portion 511 into respective holes 16 of two spaced apart legs 17 extending in a symmetrical manner relative to the holder 15 from the inner side wall of the lid body. Preferably, a biasing element may be provided to bias the drink lever 51 toward the sealed position. According to an embodiment, a first torsion spring 515 may be provided around the stubs 514 to constantly apply an upward pressure to the drink lever 51. The drink seal 31, preferably made of rubber, for closing the drink orifice 13 is mounted atop the upper portion 512 of the drink lever 51, for example by inserting two downwardly extending legs 311 into respective slots of the upper portion 512, and moves pivotally along with the pivotal movement of the drink lever 51.

On the other hand, the first sealing mechanism includes a vent lever 52, the vent lever 52 may be mounted on the drink lever 51 and movable between a sealed position and an unsealed position. In an embodiment, the vent lever 52 may be pivotable between the sealed position, the unsealed position, and a threshold position in which the vent lever 52 abuts against the drink lever 51. The vent lever 52 includes a main lever body 521 and a bevel face 522. The vent lever 52 may be pivotally mounted on the drink lever 51 by inserting two opposite stubs 523 extending from the underside of the main lever body 521 into respective holes 516 of the lower portion 511 of the drink lever 51 in the illustrated embodiment. It may be possible to pivotally mount the vent lever 52 on the lid body or on the lid body and the drink lever 51. Preferably, a biasing element is provided to bias the vent lever 52 toward its sealed position. According to an embodiment, a second torsion spring 524 may be provided around the stubs 523 to constantly apply an upward pressure to the vent lever 52. The vent seal 32, preferably made of rubber, for closing the gas vent 12 may be mounted atop the main lever body 521 of the vent lever 52, for example by inserting a downwardly extending leg (not shown) into a slot (not shown) of the main lever body 521, and moves pivotally along with the pivotal movement of the vent lever 52.

Figure 7A:
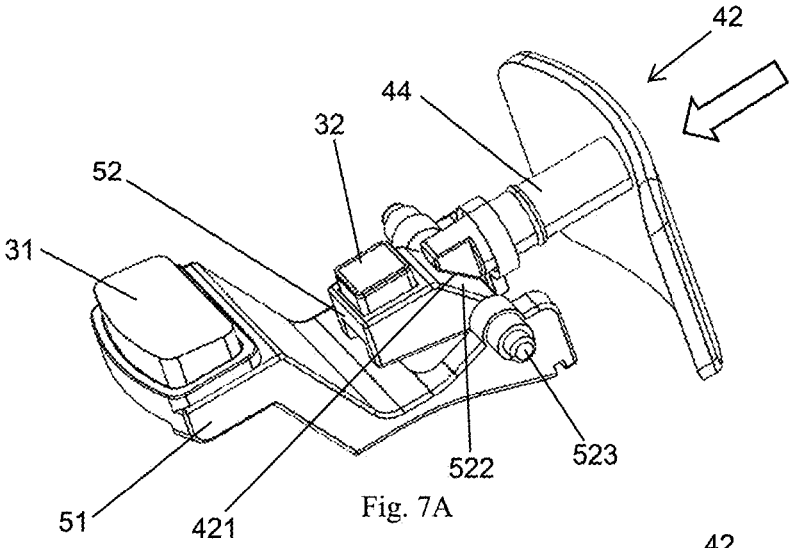
FIG. 7A to FIG. 7C illustrate the actuation process of the first and second sealing mechanism by the actuator.

The actuator 42 has an inner end 44 in abutment against the bevel face 522 of the vent lever 52, and configured to be moveable in a linear direction. As shown in FIG. 6A, the cover 20 is pivoted to its fully open position where the cover 20 lies on the first lower surface zone 11A of the lid body 10 to expose the drink orifice 13, with the arcuate recess 23 thereof in communication with the gas vent 12. The lid assembly 1 remains in the closed position in which the drink seal 51 is pressed against the drink orifice 13 to seal the drink orifice 12 and the vent seal 52 is pressed against the gas vent 12 to seal the gas vent 12, as also shown in FIG. 7A. Now referring to FIG. 6B and FIG. 7B, when the push button 41 is pushed by the user, the actuator 42 moves inwardly along a longitudinal direction of the holder 15, and the inner end 44 of the actuator 42 comes into contact with the bevel face 522 of the vent lever 52 and pushes to cause the vent level 52 to pivot downwardly with the vent seal 32 carried thereon, thereby to drive the movement of the vent seal 32 away from the gas vent 12. Essentially, the actuator includes a cam surface 421 at the inner end 44 for engaging with an inclined surface i.e., the bevel face 522, on the vent lever 52. Upon initial actuation of the actuator 52, as shown in FIG.

Figure 7B:
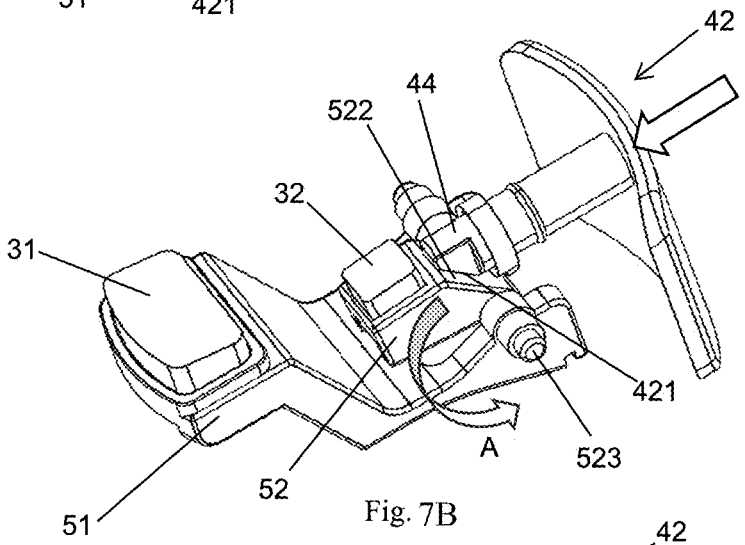

7A, the cam surface 421 imparts a pivotal action (shown by arrow A) on the vent lever 52 causing it to pivot toward the threshold position. According to this arrangement, the gas vent 12 may be opened by the pression of the actuator 42, creating a venting channel together with the arcuate recess 23 formed on the pivot 21 of the cover 20, which venting channel allows the gas within the lid assembly 1 to exit. The threshold position of the vent lever 52 is the position which the vent lever 52 abuts against a surface of the drink lever 51, as shown in FIG. 7B. Further actuation of the actuator 42 causes the vent lever 52, at the threshold position, to impart a pivoting action (shown by the arrow B) on the drink lever 51 toward its unsealed position, as depicted in FIG. 7C.

Figure 7C:
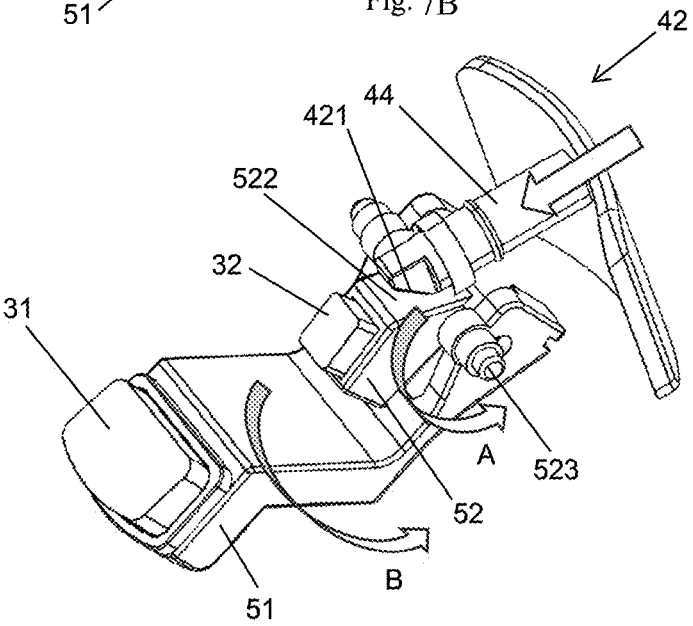

The user pushing the push button 41 further causes the main lever body 521 of the vent lever 52 to pivot downwardly further until the vent lever 52 acts on the lower portion 511 of the drink lever 51 as shown in FIG. 6C and FIG. 7C. The vent lever 52 continues to pivot downwardly so as to press the drink lever 51 to pivot downwardly with the drink seal 31 carried thereon, thereby to drive the movement of the drink seal 31 away from the drink orifice 13. In this way the drink orifice 13 is opened by the pivotal movement of the vent lever 52, allowing the beverage to flow out of the container for dispensing. Essentially, the actuator 42, when moving in an actuating direction, engages with the vent lever 52 to cause the vent lever 52 to pivot downward to unseal the gas vent 12. Moving the actuator 42 further in the actuating direction causes the vent lever 52 to act on the drink lever 51 to pivot the drink lever 51 downward, thereby unsealing the drink orifice 13.

A compression spring 45 may be provided and mounted around the actuator 42 and held in the holder 15 of the lid body 10. The compression spring 45 may be configured to constantly apply an outward pressure to the push button 41, that is, against the force exerted by the user pushing the push button 41. When the push button 41 is released and returns by the compression spring 45 to its original position, the vent lever 52 and thus the drink lever 51 both are forced to pivot upwardly by the first torsion spring 515 and the second torsion spring 524, respectively, until the vent seal 32 and the drink seal 31 return to the respective positions for sealing the gas vent 12 and the drink orifice 13.

The above described is the preferred embodiments of the container lid assembly according to the present invention. It is understood that any appropriate modifications can be adopted as long as the effect of actuating the vent lever to open the gas vent before opening the drink orifice and the vent lever acting on the drink lever to cause the drink orifice to be opened for dispensing the beverage from the container.

It should be understood that although the specification is described in terms of embodiments, not every embodiment includes only a single technical solution. This description of the specification is merely for the sake of clarity. Those skilled in the art should regard the specification as a whole, and the technical solutions in the embodiments can also be combined appropriately to form other embodiments that can be understood by those skilled in the art. However, the protection scope of the present invention is defined by the appended claims rather than the foregoing description, and it is therefore intended that all changes that fall within the meaning and scope of equivalency of the claims are included in the present invention and any reference signs in the claims should not be regarded as limiting the involved claims.

What is claimed is:

1. A lid assembly for a beverage container, comprising:

a lid body adapted for detachably coupled to the beverage container, the lid body having a drink orifice and a gas vent, each being sealable to block fluid communication with the beverage container;

a first sealing mechanism configured for sealing and unsealing the gas vent;

a second sealing mechanism configured for sealing and unsealing the drink orifice;

an actuator for actuating and de-actuating the first and second sealing mechanisms;

wherein the actuator is configured for sequentially actuating the first and the second sealing mechanisms, causing the gas vent to unseal as a result of an initial actuation of the actuator, and subsequently causing the drink orifice to unseal as a result of a further actuation of the actuator, characterized in that, said lid assembly further comprising a cover adapted for concealing the drink orifice and the gas vent, wherein the cover is pivotally mounted on the lid body, and is pivotable between an open position and a closed position, and wherein the cover comprising an arcuate recess, with the cover in the open position, the arcuate recess aligning with the gas vent for allowing gas to exit from the gas vent therethrough.

2. The lid assembly of claim 1, wherein the actuator is further configured for causing the drink orifice to seal as a result of an initial de-actuation of the actuator, and subsequently causing the gas vent to seal as a result of a further de-actuation of the actuator.

3. The lid assembly of claim 1, wherein the second sealing mechanism comprises a drink lever movable between a sealed position and an unsealed position, a biasing element is provided to bias the drink lever toward the sealed position.

4. The lid assembly of claim 3, wherein the first sealing mechanism comprises a vent lever, the vent lever is mounted on the drink lever and is movable between a sealed position and an unsealed position, a biasing element is provided to bias the vent lever toward the sealed position.

5. The lid assembly of claim 4, wherein the vent lever is pivotable between the sealed position, the unsealed position, and a threshold position in which an abutting portion of the vent lever abuts against the drink lever.

6. The lid assembly of claim 5, wherein the actuator comprises a cam surface adapted for engaging with an inclined surface on the vent lever, and wherein upon initial actuation of the actuator, the cam surface imparts a pivotal action on the vent lever toward the threshold position.

7. The lid assembly of claim 6, wherein further actuation of the actuator causes the vent lever, at the threshold position, to impart a pivoting action on the drink lever toward its unsealed position.

8. The lid assembly of claim 4, wherein the biasing element of the drink lever and/or the vent lever is a torsion spring.

9. The lid assembly of claim 1, wherein the actuator is moveable in a linear direction.

10. The lid assembly of claim 1, wherein the first and second sealing mechanisms comprise respective sealing members, the sealing members are formed of a resilient material to provide a substantially fluid-tight seal when in the closed position.

11. The lid assembly of claim 1, wherein the lid body further comprises a coupling portion extending downwardly from a top surface of the lid body, the coupling portion being configured to engage a corresponding rim of the beverage container to provide a substantially fluid-tight seal.

12. The lid assembly of claim 1, wherein the cover is configured such that in the closed position the actuator is prohibited from being actuated.

13. A lid assembly for a beverage container, comprising:

a lid body comprising a top surface defining a drink orifice and a gas vent formed therethrough, a drink lever pivotally mounted within the lid body;

a drink seal provided on the drink lever which is spring-biased toward the drink orifice to form a seal for the drink orifice;

a vent lever pivotally mounted within the lid body;

a vent seal provided on the vent lever which is spring-biased toward the gas vent to form a seal for the gas vent;

and an actuator movable with respect to the lid body;

wherein the actuator is configured to, when moving in an actuating direction, engage with the vent lever to cause the vent lever to pivot downward to unseal the gas vent, and moving the actuator further in the actuating direction causes the vent lever to act on the drink lever to pivot the drink lever downward, thereby unsealing the drink orifice, characterized in that, said lid assembly further comprising a cover adapted for concealing the drink orifice and the gas vent, wherein the cover is pivotally mounted on the lid body, and is pivotable between an open position and a closed position, and wherein the cover comprises an arcuate recess, with the cover in the open position, the arcuate recess aligns with the gas vent for allowing gas to exit from the gas vent therethrough.

14. The lid assembly of claim 13, wherein the vent lever is pivotally mounted on the drink lever.

* * * * *